US008998594B2

(12) United States Patent
Pawellek

(10) Patent No.: US 8,998,594 B2
(45) Date of Patent: Apr. 7, 2015

(54) VANE CELL PUMP WITH VANE PLATE GUIDE CROSSPIECES AND SYNCHRONIZATION CYLINDER

(75) Inventor: Franz Pawellek, Lautertal (DE)

(73) Assignee: Geraete- und Pumpenbau GmbH Dr. Eugen Schmidt, Merbelsrod/Thueringen (DE)

( * ) Notice: Subject to any disclaimer, the term of this patent is extended or adjusted under 35 U.S.C. 154(b) by 259 days.

(21) Appl. No.: 13/701,594

(22) PCT Filed: May 31, 2011

(86) PCT No.: PCT/DE2011/001140

§ 371 (c)(1),
(2), (4) Date: Dec. 3, 2012

(87) PCT Pub. No.: WO2011/150917

PCT Pub. Date: Dec. 8, 2011

(65) Prior Publication Data

US 2013/0078127 A1 Mar. 28, 2013

(30) Foreign Application Priority Data

Jun. 4, 2010 (DE) ..... 10 2010 022 677

(51) Int. Cl.

| | |
|---|---|
| ***F04C 2/00*** | (2006.01) |
| ***F04C 2/344*** | (2006.01) |
| ***F04C 14/22*** | (2006.01) |
| ***F01C 21/08*** | (2006.01) |

(52) U.S. Cl.

CPC ..... *F04C 2/00* (2013.01); *F01C 21/0836* (2013.01); *F04C 2/3442* (2013.01); *F04C 14/223* (2013.01); *F04C 14/226* (2013.01); *F04C 2240/20* (2013.01)

(58) Field of Classification Search

USPC ..... 418/16, 29, 30, 31, 260, 261, 264

See application file for complete search history.

(56) References Cited

U.S. PATENT DOCUMENTS

| | | | |
|---|---|---|---|
| 2,782,724 | A | 2/1957 | Humphreys |
| 3,143,079 | A | 8/1964 | Carner |
| 4,531,893 | A | 7/1985 | Okoh et al. |
| 5,490,770 | A | 2/1996 | Oogushi |
| 5,752,815 | A | 5/1998 | Müller |
| 5,800,131 | A | 9/1998 | Lehmann et al. |
| 7,614,858 | B2 | 11/2009 | Tanasuca |
| 2011/0293458 | A1 | 12/2011 | Schmidt et al. |

FOREIGN PATENT DOCUMENTS

| | | |
|---|---|---|
| CA | 2 143 719 | 3/1994 |
| DE | 29 14 282 | 10/1980 |
| DE | 33 34 919 | 3/1984 |

(Continued)

OTHER PUBLICATIONS

International Search Report of PCT/DE2011/001140, Jun. 13, 2013.

*Primary Examiner* — Mary A Davis

(74) *Attorney, Agent, or Firm* — Collard & Roe, P.C.

(57) ABSTRACT

The invention relates to a vane cell pump, having a rotor mounted in a pump housing and driven by a shaft, multiple vane plates mounted in this rotor in radially displaceable manner, and an outer ring surrounding the rotor and the vane plates, whereby this ring is disposed either directly in the pump housing or in a setting ring that can be moved in the pump housing along predetermined paths.

7 Claims, 6 Drawing Sheets

(56) References Cited

FOREIGN PATENT DOCUMENTS

Figure 1:
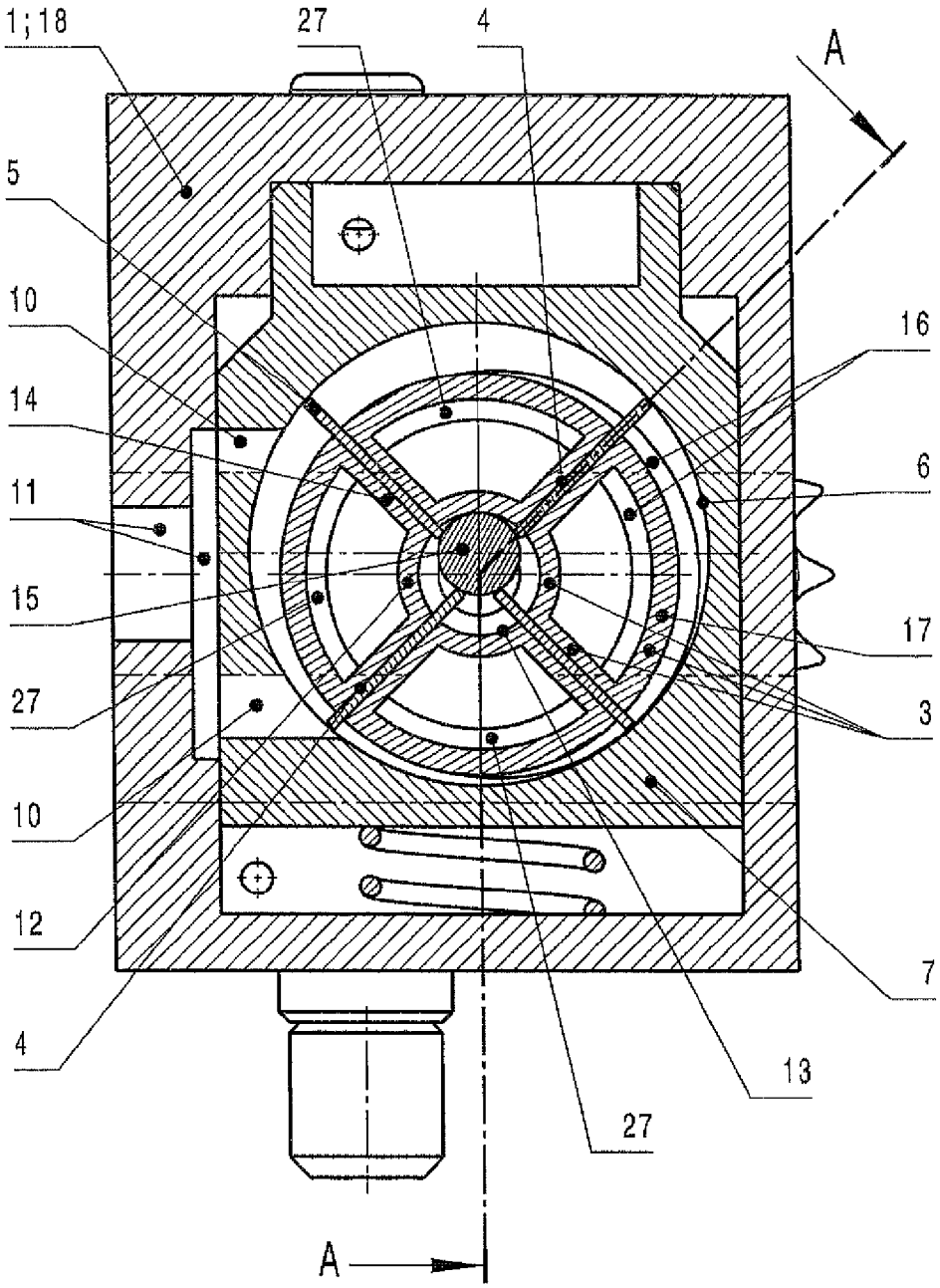

| | | | | | |
|---|---|---|---|---|---|
| DE | 92 11 768 | | 11/1992 | | |
| DE | 43 02 610 | | 8/1994 | | |
| DE | 44 42 083 | | 6/1995 | | |
| DE | 195 33 686 | | 3/1997 | | |
| DE | 103 53 027 | | 6/2005 | | |
| DE | 602 07 401 | | 8/2006 | | |
| DE | 10 2005 017 8 | | 10/2006 | | |
| DE | 11 2005 002 6 | | 9/2007 | | |
| DE | 10 2008 036 3 | | 2/2010 | | |
| DE | 10 2008 059 7 | | 6/2010 | | |
| EP | 0 135 091 | | 3/1985 | | |
| EP | 1 043 503 | | 10/2000 | | |
| JP | 59058186 | A * | 4/1984 | ..... | F04C 15/02 |
| JP | H04-175481 | A | 6/1992 | | |
| WO | WO 02/081921 | | 10/2002 | | |
| WO | WO 2006/045190 | | 5/2006 | | |

* cited by examiner

VANE CELL PUMP WITH VANE PLATE GUIDE CROSSPIECES AND SYNCHRONIZATION CYLINDER

CROSS REFERENCE TO RELATED APPLICATIONS

This application is the National Stage of PCT/DE2011/001140 filed on May 31, 2011, which claims priority under 35 U.S.C. §119 of German Application No. 10 2010 022 677.7 filed on Jun. 4, 2010, the disclosures of which are incorporated by reference. The international application under PCT article 21(2) was not published in English.

The invention relates to a vane cell pump, having a rotor mounted in a pump housing and driven by a shaft, multiple vane plates mounted in this rotor in radially displaceable manner, and an outer ring surrounding the rotor and the vane plates, whereby this ring is disposed either directly in the pump housing or in a setting ring that can be moved in the pump housing along predetermined paths.

In the state of the art, the most varied embodiments of vane cell pumps are known. For example, DE 29 14 282 C2 as well as DE 103 53 027 A1 describe regulatable vane cell pumps, in each instance, having a linearly displaceable setting ring for achieving a variable conveying output.

In most cases, on both sides of the rotor of a vane cell pump, a suction kidney is disposed on the one side, and a pressure kidney offset from the former by 180° is disposed on the other side.

It is also characteristic for the two aforementioned constructions that the vane plates are always pressed against the outer ring solely by means of the centrifugal forces that act, during rotation of the rotor, on the vane plates that are mounted to be radially displaceable in bearing slots of the rotor.

At low speeds of rotation, in particular, i.e. at idle speeds of rotation of a motor vehicle engine, for example, such "centrifugal force sealing" has the disadvantage of relatively high leakage losses, even if the vane plates are configured to be rather massive, i.e. their wall thickness is structured to be "thick."

At higher speeds of rotation, these massive, heavy vane plates, i.e. structured with a "thick" wall thickness, then necessarily lead to high friction losses at the inner radius of the outer ring.

In EP 1 043 503 A2, a further construction of a regulatable vane cell pump having a setting ring mounted to pivot is now previously described. In the case of this construction, as well, the vane plates are pressed against the outer ring solely by means of the centrifugal force that acts, during rotation of the rotor, on the vane plates that are mounted to be radially displaceable in bearing slots of the rotor, and this in turn results in the disadvantages already explained.

In order to eliminate the disadvantages that result from the "centrifugal force seal," the most varied forms of synchronization rings have been installed into vane cell pumps, as disclosed, for example, also in DE 43 02 610 A1, EP 0135 091 A1, DE 195 33 686 A1, WO 2006/045 190 (DE 11 2005 002 644 T5) or also DE 10 2008 036 327 A1.

This additional placement of such synchronization rings necessarily requires increased production and assembly effort, whereby at a maximal deflection of the setting ring, because of the "short" vane guide in the rotor, and the accompanying great bending moment at the vane plates, a vane thickness of at least 3 mm is always adhered to in order to avoid "vane tilting."

As a result, relatively high friction losses still occur in the case of these constructions, as well.

As compared with the constructions described above, the seal at the outer ring is increased on the basis of the use of synchronization rings, particularly in the lower speed of rotation range.

Because the synchronization rings are produced by fine-blanking, for production technology reasons, production tolerances of approximately 0.15 mm remain, so that the volumetric losses that occur as a function of the gap width cubed can be lowered only in restricted manner.

A further reduction of the volumetric losses requires significantly greater production effort in the case of use of synchronization rings.

In DE 92 11 768.6 U1, a vane machine having a tubular rotor and vanes/vane slots having radial recesses is previously described, among other things, in which machine filling of the conveying cells with the required medium takes place by way of the hollow rotor axis and the radial recesses in the vanes or in the rotor.

This embodiment is very production-intensive, cost-intensive, wear-susceptible and furthermore also very "sensitive," i.e. susceptible to failure with regard to the particles entrained by the conveying medium.

Other regulatable vane cell pumps having a suction kidney and pressure kidney as well as linearly displaceable setting rings for achieving a variable conveying output were previously described in U.S. Pat. No. 2,782,724 A and U.S. Pat. No. 3,143,079 A, for example, in which the rotor, which is connected with the drive shaft, is configured in tubular manner, whereby bearing grooves are disposed in its walls, which penetrate radially completely through the wall.

Vane plates that project radially through the rotor are displaceably mounted in the bearing grooves.

These vane plates, which project through the rotor, lie against a cylinder anchored with regard to the housing, in its center axis, in the interior of the rotor, which cylinder is connected with the pump housing by means of a screw, for example.

These constructions also, once again, require relatively great vane thicknesses at maximal deflection of the setting ring, because of the great accompanying bending moment at the freely projecting vane plates, in order to avoid "vane tilting," so that in the case of these constructions, as well, great friction losses occur.

Furthermore, the solution presented in U.S. Pat. No. 2,782,724 A, in particular, is also very production-intensive, because of the required great production precision to guarantee freedom from leaks, and therefore is very cost-intensive in its production.

For the construction disclosed in EP 0135 091 A1, a special configuration of the inflow and outflow regions is furthermore characteristic. In place of the generally usual inflow and outflow kidneys, arc-shaped recesses that lie opposite one another are disposed in the cylindrical inner ring of the setting slide.

However, this special configuration of the inflow and outflow regions is very production-intensive, cost-intensive, wear-susceptible and furthermore very "sensitive," i.e. susceptible to failure with regard to the particles entrained by the conveying medium.

All of the previously mentioned constructions have in common that the outer edge of the rotor is always configured in arc shape, i.e. as an arc corresponding to the outside diameter of the rotor, in each instance, between the bearing points of the vane plates.

In DE 33 34 919 C2, DE 44 42 083 A1, but also in WO 2002/081921 (DE 602 07 401 T2), constructions of vane cell pumps having a variable conveying output are previously described, in which transverse grooves are disposed on/in the lower edge of each cell chamber, i.e. in the "cylinder mantle surface" of the rotor, in each instance, which grooves run over the entire rotor width, parallel to the bearing grooves of the vane plates, at the lower edge of each cell chamber, are spaced apart from the bearing grooves, are always configured symmetrical to the center axis of each cell chamber, are formed at least almost in trapezoid shape in their cross-section, and are supposed to increase the volume of the pump chambers, in each instance.

In accordance with the eccentricity of the rotor, in each instance, relative to the outer ring, the vane cell pump, in each instance, then pumps the conveyed volume stream from the suction kidney into the pressure kidney, as a displacer pump.

A further construction of a displacer pump having such enlarged displacer chambers was also previously described by the applicant in DE 10 2005 017 834 A1.

A significant disadvantage of these previously mentioned constructions of vane cell pumps of the current state of the art also consists in that at drive speeds of rotation in the range of 4500 rpm to over 6000 rpm (e.g. when using these vane cell pumps as oil pumps driven directly by the crankshaft of a vehicle engine), filling of the vane cells (pump chambers) takes place incompletely, with all the disadvantages resulting from this, such as, among other things, high power losses, increased noise development, increased wear, and more of the like.

For this reason, the applicant proposed a special non-symmetrical transverse groove construction in DE 10 2008 059 720 A1.

The significant disadvantages of all the aforementioned constructions consists, however, not only in the necessarily required great production and assembly effort for minimizing the friction losses and the radial play of the vanes, and thus the leakage losses (volumetric losses), and achieving a reasonable degree of effectiveness, but also in the necessarily required great construction space outside diameter, in order to form effective displacer chambers even at the fillable chamber widths, which are relatively narrow both in terms of design and due to production conditions, whereby the great inside radii of the outer rings necessarily result in great friction moments resulting from the vane friction forces (on the outer ring).

The task of the invention now consists of developing a new type of vane cell pump, which eliminates the aforementioned disadvantages of the state of the art, lowers the friction and leakage losses, guarantees optimal filling and emptying of the pump chambers, in terms of flow technology, in the lower as well as the upper speed of rotation range, at a minimal outside diameter, while it clearly lowers the power losses, particularly minimizes the friction losses, is furthermore simple to produce and assemble, in terms of production technology, and clearly reduces the production costs, at the same time is "not sensitive to particles," minimizes the wear of the assemblies, increases reliability and useful lifetime, and is characterized by low-noise operation even at high speeds of rotation, and, in this connection, guarantees a great specific conveying volume stream at a high volumetric degree of effectiveness both at low and at high speeds of rotation.

According to the invention, this task is accomplished by means of a vane cell pump having a pump housing (1) and a rotor shaft (12), wherein the rotor shaft (12) consists of a drive shaft (2) mounted in the pump housing (1) and a hollow rotor shaft (24) connected with the drive shaft (2), wherein in certain regions, radial bearing grooves (4) are disposed in the wall of the hollow rotor shaft (24), in which grooves vane plates (5) that project radially through the hollow rotor shaft (24) are mounted in radially displaceable manner, wherein the hollow rotor shaft (24) with the vane plates (5) is enclosed by the cylinder mantle of an inner cylinder (6), which is disposed in a setting slide (7) that is mounted in the pump housing (1) to be displaceable or pivotable along predetermined paths, having an inflow channel (8) disposed in the pump housing (1), into which (an) inflow kidney(s) (9) disposed in the side wall(s) of the pump housing (1) on one or both sides of the setting slide (7) empties/empty, having an outflow channel (11) also disposed in the pump housing (1), wherein the vane cell pump according to the invention is characterized in that a cylinder guide (13) is disposed in the hollow rotor shaft (24), in which guide a freely circulating synchronization cylinder (15), not rigidly connected with the adjacent assemblies, is guided, and that vane-shaped vane plate guide crosspieces (14) having bearing grooves (4), which crosspieces project beyond the hollow rotor shaft (24) radially by approximately 0.75 to 1.8 times the diameter of the synchronization cylinder (15) in the region of these bearing grooves (4), and are assigned to the bearing grooves (4) disposed in the wall of the hollow rotor shaft (24), are rigidly disposed on the hollow rotor shaft (24), in such a manner that the hollow rotor shaft (24) forms a vane rotor (3) together with the vane plate guide crosspieces (14), and that the bearing grooves (4) in the wall of the hollow rotor shaft (24) lie in the plane of the bearing grooves (4) of the vane plate guide crosspieces (14) assigned to them, in each instance, and make a transition into these, in such a manner that the vane plates (5) disposed in the bearing grooves (4) of the vane plate guide crosspieces (14) of the vane rotor (3) reach all the way into the cylinder guide (13), wherein the vane plates (5) disposed in the bearing grooves (4) of the vane rotor (3) lie both against the synchronization cylinder (15) "on the inside" and against the inner cylinder (6) of the setting slide (7) "on the outside."

The vane rotor (3) formed by means of the placement of the vane plate guide crosspieces (14) on the hollow rotor shaft (24), according to the invention, brings about great mechanical stability even of "thin" vane plates, which therefore rotate with little friction, on the one hand, because of the guidance of the vane plates in the bearing grooves of the vane plate guide crosspieces (14), which grooves are very "long," according to the invention.

At the same time, the vane plate guide crosspieces (14) of the vane rotor (3), which are very "long," according to the invention, bring about not only the "cell pump effect" but also a "centrifugal pump effect" that is superimposed on the "cell pump effect," which effect fully comes to bear by means of the simultaneous placement, according to the invention, of outflow openings (10) disposed in the setting slide (7), which are continuous, run radial to the inner cylinder (6), and lie opposite the inflow kidney(s) (9) disposed in the side wall(s) of the pump housing (1), on the pump working side.

In addition, the placement according to the invention furthermore brings about the result that the vane cell pumps according to the invention can be built with a significantly smaller inner cylinder diameter (diameter of the inner cylinder (6)) and significantly wider vane plates (5), i.e. a greater chamber length, so that optimal filling and emptying of the pump chambers, in terms of flow technology, is always guaranteed at a minimal outside diameter, both in the lower and the upper speed of rotation range. At the same time, because of the "long" vane guide in the bearing grooves (4), the seal in the vane guides is significantly increased, and therefore the leakage losses that occur there are also clearly reduced, at the same time.

Because furthermore, it is possible to clearly reduce the friction radii of the vanes, and thereby the friction moments and thus also the friction losses, while the chamber volume remains the same, as compared with previous vane cell pumps, it is possible to lower the power losses by means of the solution according to the invention, on the one hand, and to guarantee a high specific conveying volume stream with a high volumetric degree of effectiveness both at low and at high speeds of rotation, in the totality of all the effects described until now.

The synchronization cylinder (15) that rotates in a cylinder guide (13), according to the invention, takes over the task, in the present invention, of the synchronization rings (stroke rings) previously described in the state of the art.

As compared with the stroke rings, the cylinder rollers according to the invention can be produced at significantly greater production precision, at significantly lower costs, because such synchronization cylinders (15) can be produced, for example, by means of centerless grinding, at maximal production precision.

According to the invention, the sealing gap between the vane plates (5) and the inner cylinder (6) can be very clearly reduced to less than a tenth of a millimeter by means of the synchronization cylinder (15).

According to the invention also that in place of the synchronization cylinder (15) a ball is arranged, which brings about synchronization of the vane plates (5).

Because the leakage stream is proportional to the cube of the gap height, this significant reduction in the sealing gap between the vane plates (5) and the inner cylinder (6) has major effects on the leakage stream at the sealing gap between the vane plates (5) and the inner cylinder (6), and thereby more than clearly reduces the leakage stream that occurs, as compared with the state of the art.

This solution, according to the invention, can be produced in simple manner, in terms of production technology, and can also be assembled easily, thereby clearly reducing the production costs.

The entire arrangement is simultaneously robust and "non-sensitive to particles," thereby minimizing the wear of the assemblies and clearly increasing the reliability and useful lifetime of the vane cell pump according to the invention. In this connection, the vane cell pump according to the invention is particularly characterized by the precise guidance by means of low-noise operation even at high speeds of rotation.

The gap dimensions, which are clearly reduced as compared with conventional constructions, guarantee a further increase in the volumetric degree of effectiveness both at low and at high speeds of rotation.

Also in accordance with the invention, however, is a special configuration of the invention, in which the vane plate guide crosspieces (14) are connected with one another at their outer circumference by means of an outer ring (17) provided with bearing grooves (4), whereby overflow kidneys (16) that surround the outer ring (17) are disposed in the inflow region provided with the inflow kidney (9), on one or both sides of the setting slide (7), in the region of the outer ring (17), i.e. in the side wall(s) of the pump housing (1), which allow inflow of the conveying medium out of the inner chamber(s), around the outer ring (17), into the outer displacer cells, by way of the overflow kidneys (16).

These inner chambers of a "closed" vane rotor (3) formed from the vane plate guide crosspieces (14) and the outer ring (17) here, according to the invention, bring about a centrifugal pump effect that occurs in the inner chambers, when the vane rotor (3) is rotating, also in the case of this construction of the solution according to the invention, which effect brings about inflow of the conveying medium from the inner chambers into the outer displacer cell(s), by way of the overflow kidneys (16) according to the invention, i.e. around the outer ring (17).

The circumferential guide groove (27) disposed in the region of the outer edge of the inner chambers, adjacent to the outer ring (17) in the side wall of the pump housing (1), which line makes a transition into the overflow kidneys (16), furthermore guarantees, according to the invention, highly effective inflow of the conveying medium from the inner chambers into the overflow kidney (16), by way of the circumferential guide groove (27), and from there into the outer displacer cell(s).

The effect also achieved by means of this construction of the solution according to the invention once again consists of the superimposition, according to the invention, of a centrifugal pump that lies on the inside and a displacer pump that lies on the outside, whereby once again, filling free of gas bubbles is brought about in the entire range of the speed of rotation, so that the displacer cells of the pump according to the invention are always filled in optimal, highly effective, and complete manner, over the entire range of the speed of rotation.

The task on which the present invention is based can be completely accomplished, in its totality, also with this embodiment of the solution according to the invention.

Advantageous embodiments and further details and characteristics of the invention are evident from the dependent claims as well as from the following description of the exemplary embodiments according to the invention, in connection with the drawings related to the individual constructions of the solution according to the invention.

In the following, the invention will now be explained in greater detail, using multiple exemplary embodiments in connection with six figures.

Figure 2:
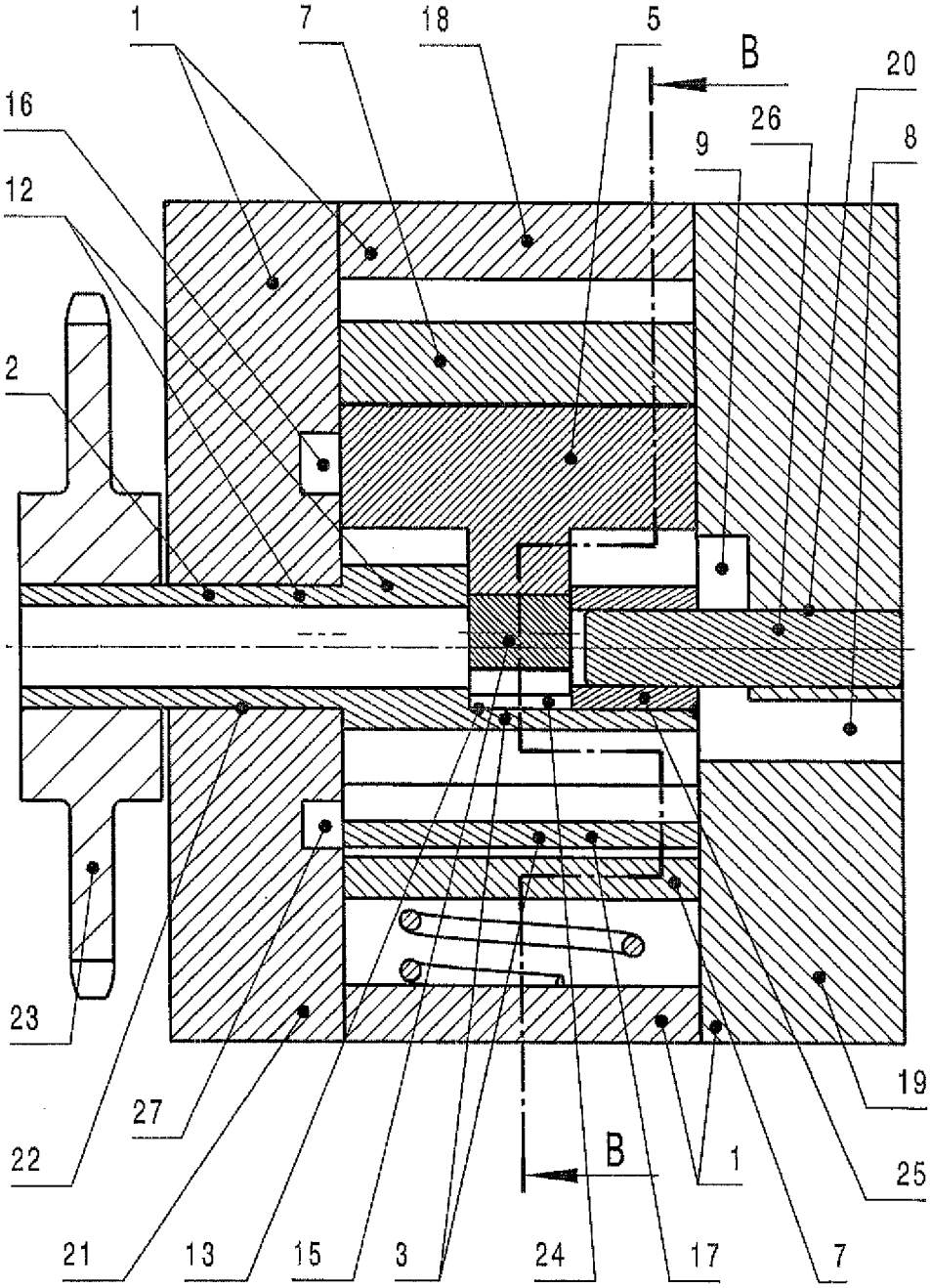
Figure 3:
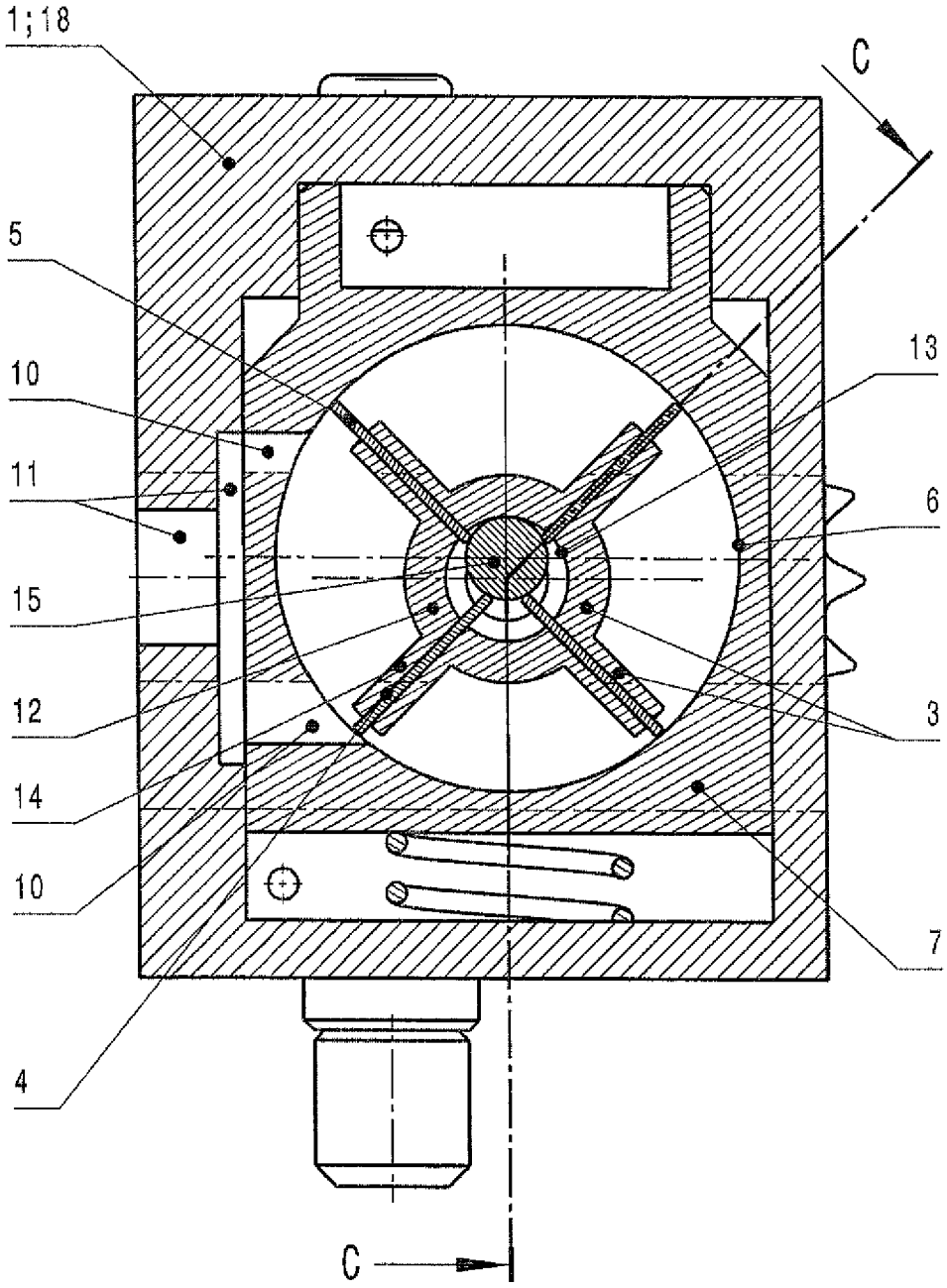
Figure 4:
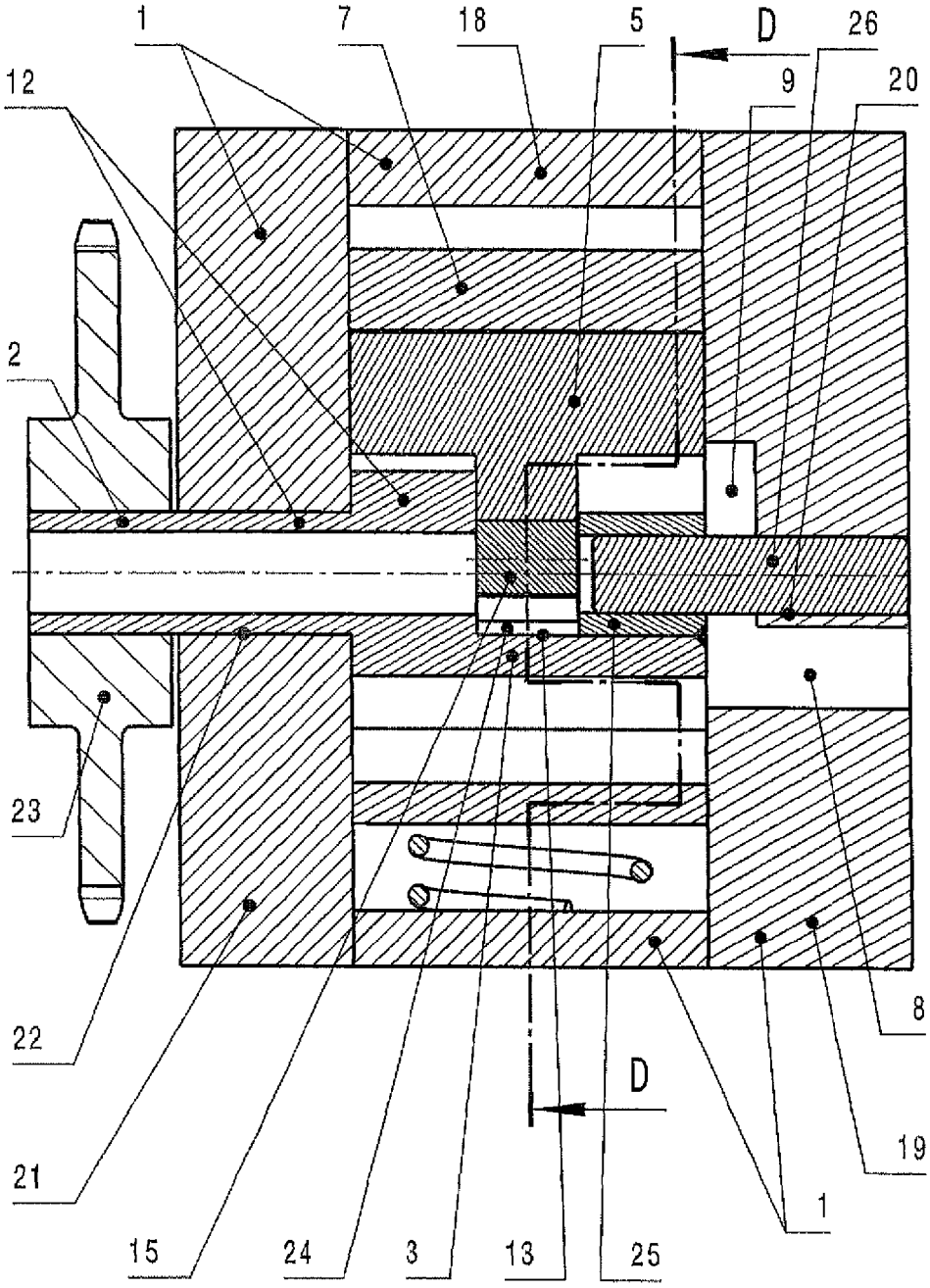
Figure 5:
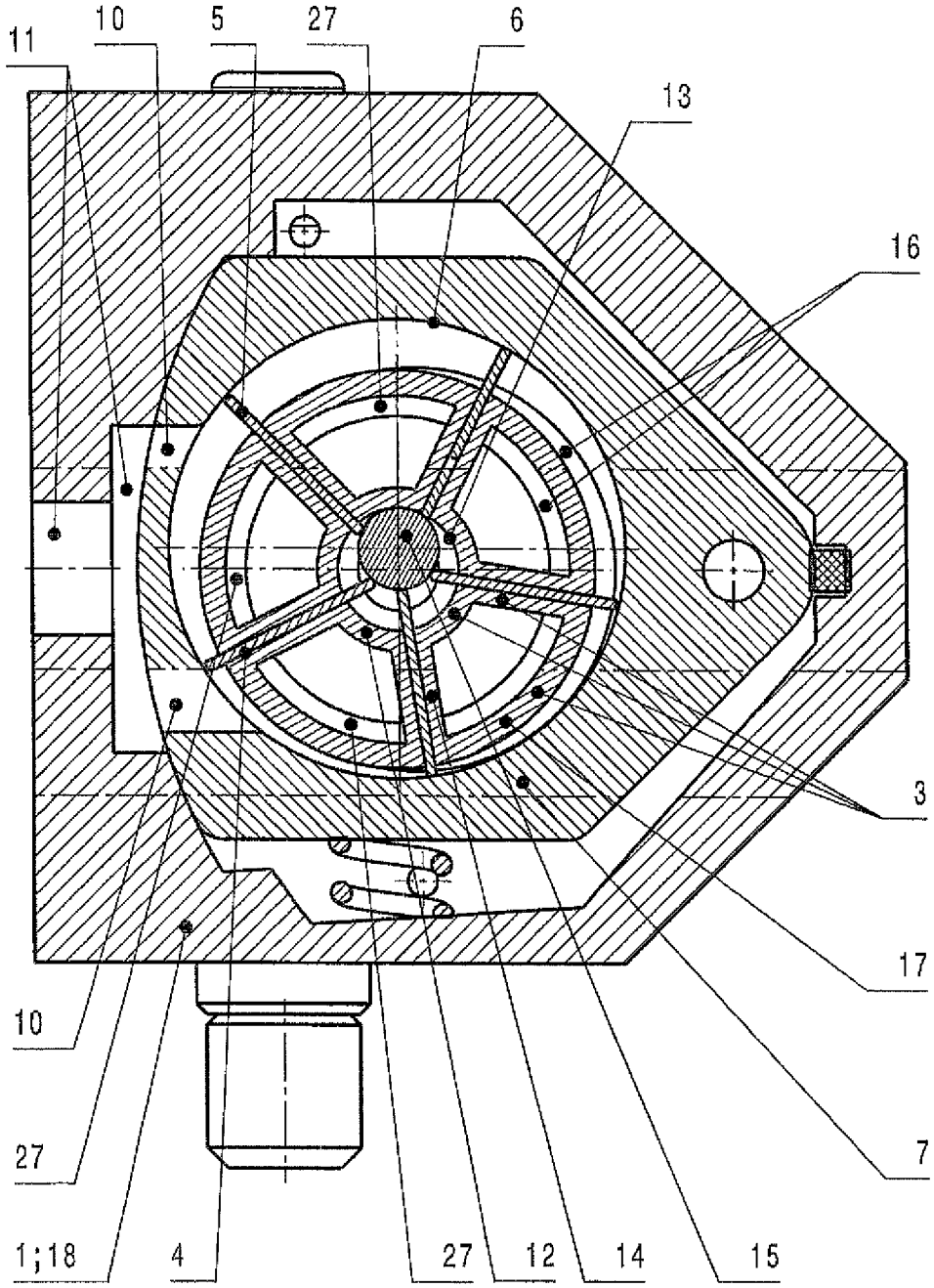
Figure 6:
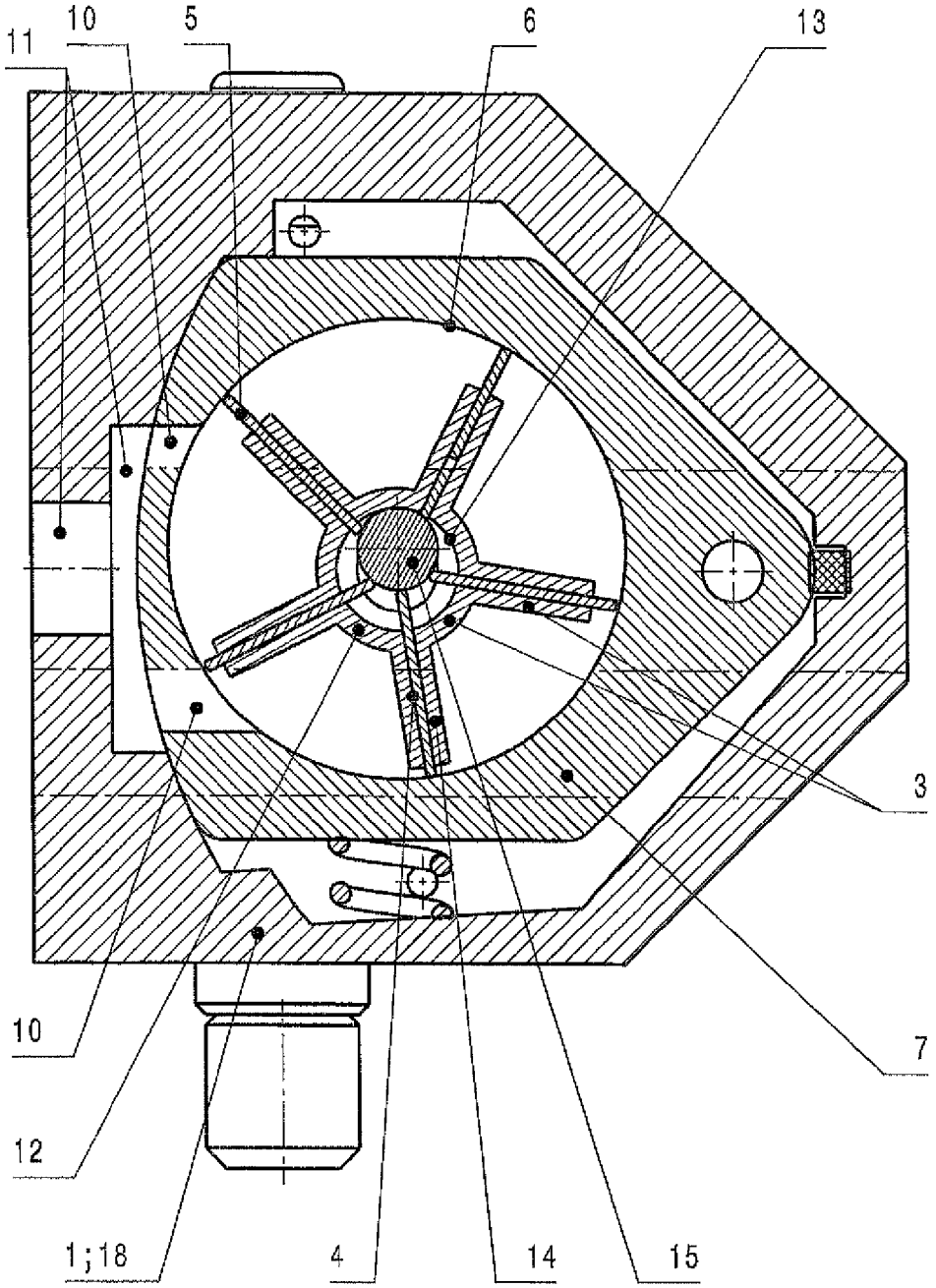

These show:

FIG. 1: the vane cell pump according to the invention, as a dual-chamber pump having a setting slide 7 that can be displaced in linear manner, in radial section at B-B according to FIG. 2;

FIG. 2: the vane cell pump according to the invention, as a dual-chamber pump from FIG. 1, having a setting slide 7 that can be displaced in linear manner, in a side view in section at A-A according to FIG. 1;

FIG. 3: the vane cell pump according to the invention, as a free-chamber pump having a setting slide 7 that can be displaced in linear manner, in radial section at D-D according to FIG. 4;

FIG. 4: the vane cell pump according to the invention, as a free-chamber pump from FIG. 3, having a setting slide 7 that can be displaced in linear manner, in a side view in section at C-C according to FIG. 3;

FIG. 5: the vane cell pump according to the invention, as a dual-chamber pump having a setting slide 7 that can be pivoted, in radial section;

FIG. 6: the vane cell pump according to the invention, as a free-chamber pump having a setting slide 7 that can be pivoted, in radial section.

In FIGS. 1 to 6, four of the possible constructions of the vane cell pump according to the invention are shown with two different constructions of setting slides 7.

All the constructions have in common that a rotor shaft 12 is disposed in a pump housing 1.

The rotor shaft 12 consists of a drive shaft 2 mounted in the pump housing 1 and a hollow rotor shaft 24 connected with the drive shaft 2.

It is characteristic for all the constructions that a cylinder guide 13 is disposed in the hollow rotor shaft 24, in which guide a freely rotating synchronization cylinder 15, which is not rigidly connected with the adjacent assemblies, is guided.

In this connection, it is essential to the invention that vane-shaped vane plate guide crosspieces 14 having bearing grooves 4, which crosspieces project beyond the hollow rotor shaft 24 radially by approximately 0.75 to 1.8 times the diameter of the synchronization cylinder 15 in the region of these bearing grooves 4 and are assigned to the bearing grooves 4 disposed in the wall of the hollow rotor shaft 24, are rigidly disposed on the hollow rotor shaft 24, in such a manner that the hollow rotor shaft 24 forms a vane rotor 3 according to the invention, together with the vane plate guide crosspieces 14.

It is furthermore characteristic that the bearing grooves 4 lie in the plane of the bearing grooves 4 of the vane plate guide crosspieces 14 assigned to them, in the wall of the hollow rotor shaft 24, and furthermore make a direct transition into these, so that the guide plates 5 disposed in the bearing grooves 4 of the vane plate guide crosspieces 14 of the vane rotor 3 reach all the way into the cylinder guide 13, whereby the vane plates 5 disposed in the bearing grooves 4 of the vane rotor 3 lie both against the synchronization cylinder 15 "on the inside" and against the inner cylinder 6 of the setting slide 7 "on the outside."

In this connection, the vane plates 5 disposed in the vane rotor 3 are surrounded, in the shape of a cylinder mantle, by an inner cylinder 6 of the setting slide 7, whereby this setting slide 7 can be linearly displaced along predetermined paths in two of the three exemplary embodiments and is mounted to pivot in the pump housing 1 in the third exemplary embodiment, whereby (an) inflow kidney(s) 9 that empties/empty into the inflow channel 8 disposed in the pump housing is/are disposed on the face side of the setting slide 7, i.e. in the side walls of the pump housing 1.

It is also essential to the invention that in all the constructions, continuous outflow openings 10 that run radial to the inner cylinder 6 are disposed in the setting slide 7, which openings lie opposite the inflow kidney(s) 9 disposed in the side wall(s) of the pump housing 1, on the pump working side.

According to the state of the art, the rotors of vane cell pumps are currently sintered and calibrated, whereby this production method greatly restricts the width of the rotor and thus the pump chamber length, and furthermore requires a minimum vane plate thickness of approximately 3 mm.

The solution according to the invention now furthermore allows the production of the vane rotor according to the invention using the significantly more cost-advantageous metal power injection-molding method, thereby making it possible to reduce the slot widths of the bearing grooves 4 and thereby the vane plate thickness to as low as 1 mm.

In connection with the guidance of the vane plates in the bearing grooves of the vane plate guide crosspieces 14, which grooves are very "long" in the radial direction, according to the invention, the mechanical stability of such "thin" vane plates 5 is also guaranteed within the scope of the solution according to the invention.

In this connection, the vane plate guide crosspieces 14, which are very "long," according to the invention, simultaneously act as a centrifugal pump, in combination with the new type of outflow openings 10 disposed radially in the inner cylinder 6.

However, the use of vane plates having a thickness of 1 mm, according to the invention, furthermore has the advantage that the centrifugal force and therefore simultaneously the friction moment that occurs on the inner cylinder 6 and therefore simultaneously the friction losses can be very clearly reduced.

At the same time, the arrangement according to the invention brings about the result that the vane cell pumps according to the invention can be built with a significantly smaller inner cylinder diameter (diameter of the inner cylinder 6) and, at the same time, significantly wider vane rotors 3, in the longitudinal axis direction, with vane plates 5 disposed in the vane plate guide crosspieces 14, i.e. with a greater chamber length.

Thus, the friction radii of the vanes, and, as a result, the friction moments and therefore also the friction losses, can be clearly reduced, while the chamber volume remains the same, as compared with previous vane cell pumps.

Furthermore, the friction losses can also be clearly reduced once again by means of a reduction in the number of vane plates in the vane cell pumps according to the invention.

The significantly longer vane plate guide crosspieces 14, with reference to the vane plate height, that are used according to the invention as compared with the previous solutions furthermore bring about significantly better vane guidance in the long bearing grooves 4, at the same time.

This results, according to the invention, in avoidance of tilting and edge running, with a clear reduction in the friction losses in the vane guides resulting from this.

At the same time, the seal in the vane guides is also increased by means of the great vane guidance, and furthermore, as a result, the volumetric losses that occur there are clearly reduced.

At the same time, the leakage flow between the vane plates and the inner cylinder is clearly reduced by means of the solution according to the invention, as compared with the previous solutions of the state of the art.

At present, in the state of the art, the lowest gap dimensions in vane cell pumps are achieved in connection with the use of synchronous rings (stroke rings). These press the vane plates against the inner cylinder during their rotation.

These synchronous rings must be produced by means of finish blanking, and are therefore subject to significantly higher tolerances as compared with the technical means/interaction relationship that is used in the present invention.

The synchronization cylinder 15 that rotates in the cylinder guide 13, according to the invention, takes on the task of the synchronous rings (stroke rings) in the present invention.

Whereby such cylinder rollers can be produced with significantly greater production precision at significantly reduced costs. For example, such synchronization cylinders 15 can be produced by means of centerless grinding, with the greatest production precision.

Therefore, the sealing gap between the vane plates 5 and the inner cylinder 6 can be very clearly reduced to below one-tenth of a millimeter, by means of the use of synchronization cylinders 15 produced in this manner, as compared with the state of the art.

Because the leakage flow acts proportional to the cube of the gap height, this significant reduction in the sealing gap between the vane plates 5 and the inner cylinder 6 has very clear effects on the leakage flow at the sealing gap between the vane plates 5 and the inner cylinder 6, as compared with the leakage flow that occurs at these locations in the state of the art.

As is shown in FIGS. 1, 2, and 5 of the present exemplary embodiments, the vane plate guide crosspieces 14 are connected with one another at their outer circumference, by means of an outer ring 17 provided with bearing grooves 4, whereby overflow kidneys 16 that surround the outer ring 17 are disposed on one or both sides of the setting slide 7, in the region of the outer ring 17, i.e. in the side wall(s) of the pump housing 1, in the inflow region provided with the inflow kidney 9, which allow inflow of the conveying medium out of the inner chamber(s), around the outer ring 17, into the outer displacer cells, by way of the overflow kidneys 16.

The inner chambers formed in this embodiment of the solution according to the invention, from the vane plate guide crosspieces 14 and the outer ring 17, bring about a centrifugal pump effect that occurs in these inner chambers, when the vane rotor 3 is rotating, which effect achieves inflow of the conveying medium from the inner chamber(s) into the outer displacer cell(s), by way of the overflow kidneys 16 according to the invention, i.e. around the outer ring 17.

It is also in accordance with the invention if a circumferential guide groove 27 is disposed in the region of the outer edge of the inner chambers, adjacent to the outer ring 17, in the side wall of the pump housing 1, which groove makes a transition into the overflow kidneys 16 and thereby brings about highly effective inflow of the conveying medium from the inner chamber(s) into the overflow kidney 16, by way of the circumferential guide groove 27, and from there into the outer displacer cell(s).

The solution according to the invention brings about the result, by means of the combinatory effect that results from the superimposition, according to the invention, of a centrifugal pump that lies on the inside and a displacer pump that lies on the outside, that the displacer cells are always filled optimally and completely, i.e. free of gas bubbles, in the entire range of the speed of rotation.

In FIG. 2, the vane cell pump from FIG. 1, according to the invention, constructed as a dual-chamber pump, is shown with a linearly displaceable setting slide 7, in a side view in section at A-A (according to FIG. 1).

According to the invention, the pump housing 1 is constructed in multiple parts, and consists of a spacer piece 18, a side plate 19 having an axle bearing 20, and a cover plate 21 having a shaft bearing 22.

It is also characteristic that the rotor shaft 12, mounted in the pump housing 1 and provided with a drive wheel 23 outside the pump housing 1, is configured in multiple pieces, whereby the hollow rotor shaft 24 has an inside diameter, in the center region of the vane rotor 3, that corresponds to the inside diameter of the cylinder guide 13.

This design structure according to the invention leads to a further reduction in the production and assembly costs.

It is essential to the invention, in this connection, that this cylinder guide 13 is laterally delimited in such a manner that a bearing ring 25 having the inside diameter of the cylinder guide 13 is disposed in the free end of the hollow rotor shaft 24, in torque-proof manner, thereby allowing cost-advantageous production and assembly.

In this connection, it is also characteristic that the hollow rotor shaft connected with the bearing ring 25 in torque-proof manner, by means of this bearing ring 25, is mounted, at the same time, so as to rotate on a bearing axle 26 disposed in the pump housing 1 in torque-proof manner.

This special "multi-part" structure, according to the invention, simultaneously lowers the production and assembly costs once again, in large-scale production, because this special "multi-part," use-oriented construction of the solution according to the invention can be produced in cost-advantageous manner, in simple manner, in terms of production technology, and also assembled automatically, while maintaining a high level of production precision.

Furthermore, the number of vane plates 5 on the vane rotor 3 can also be clearly reduced, at the same time, by means of the solution according to the invention, thereby lowering the friction losses clearly once again.

In this connection, the large inflow openings, the large chambers, as well as the large outflow openings 10 also guarantee that the vane cell pump according to the invention works "in a manner not sensitive to particles."

With the solution according to the invention, it has therefore been possible to minimize the friction losses and to clearly reduce the power losses. Because the vane cell pump according to the invention can furthermore be produced and assembled in simple manner, in terms of production technology, the production costs were clearly reduced as compared with the constructions of the state of the art.

As a result of the precise production and the low friction, the present solution is characterized not only by very low wear, great reliability, and a long useful lifetime, but also by low-noise operation, not only at low but also at high speeds of rotation, and, in this connection, guarantees a high specific conveying volume stream at a high volumetric degree of effectiveness, both at low and at high speeds of rotation (in the range of 4,500 rpm to over 6,000 rpm).

FIG. 3 now shows a further embodiment of the vane cell pump according to the invention, here as a free-chamber pump, in radial section at D-D according to FIG. 4, once again with a linearly displaceable setting slide 7.

In this embodiment as a free-chamber pump, as well, a vane rotor 3 connected with a drive shaft 2 in torque-proof manner is disposed in a pump housing 1, on the drive shaft 2.

According to the invention, the drive shaft 2 is constructed as a rotor shaft 12, in one piece with the vane rotor 3.

It is essential for this construction, too, that the rotor shaft 12 is configured, in the region of the vane rotor 3, entirely or in part, as a hollow rotor shaft 24, having a cylinder guide 13 disposed in the hollow rotor shaft 24, whereby the vane rotor 3 has vane-shaped vane plate guide crosspieces 14 that run radially, having bearing grooves 4 that reach all the way into the cylinder guide 13.

Radially displaceable vane plates 5 are mounted in these bearing grooves 4 of the vein rotor 3.

The vane rotor 3 and the vane plates 5 are surrounded, in the form of a cylinder mantle, by an inner cylinder 6 of a setting slide 7, whereby this setting slide 7 is mounted to be linearly displaceable in the pump housing 1, along predetermined paths, in the present exemplary embodiment, whereby (an) inflow kidney(s) 9 that empties/empty into an inflow channel 8 disposed in the pump housing is/are disposed on one or both sides of the setting slide 7, in the side walls of the pump housing 1.

An/Multiple outflow opening(s) 10 is/are disposed in the pump housing 1, offset from the inflow kidney(s), on the pump working side, which opening(s) empties/empty into an outflow channel 11 disposed in the pump housing 1.

In this connection, it is essential to the invention that a synchronization cylinder 15 is disposed in the cylinder guide 13, and that the vane plates 5 disposed in the bearing grooves 4 lie against both the synchronization cylinder 15 and the inner cylinder 6 of the setting slide 7, whereby the outflow opening(s) 10 that is/are disposed to lie opposite the inflow kidney 9 on the pump working side, i.e. offset by 180°, is/are disposed in the inner cylinder 6 of the setting slide 7.

It is also characteristic that in the present exemplary embodiment, the vane plate guide crosspieces 14 are not connected with one another on their outer circumference by means of an outer ring 17, and that no overflow kidneys 16 are disposed to the side of the setting slide 7, i.e. in the side wall of the pump housing 1.

This construction of the vane cell pump according to the invention, shown in FIG. 3, the so-called free-chamber pump, i.e. without the outer ring 17 that connects the vane plate guide crosspieces 14 at their outer circumference, in which the centrifugal pump that lies on the inside makes a transition, without a partition, into the displacer pump that lies on the outside, is very well suited for use in the upper speed of rotation range (i.e. these pumps predominantly run at high speed).

By means of the unhindered inflow (without deflection by way of the overflow kidneys 16) into the displacer pump, guaranteed by means of this construction, shown in FIG. 3, but also as a result of the unhindered radial outflow of the conveying medium not only from the displacer pump but, at the same time, also from the centrifugal pump, the flow losses are reduced, and in this connection, the volumetric degree of effectiveness of the pump is increased at the same time.

In FIG. 4, the vane cell pump according to the invention, structured as a free-chamber pump, is shown in a side view, in section at C-C according to FIG. 3.

According to the invention, the pump housing 1 is also constructed of multiple parts in this embodiment of the solution according to the invention, and consists of a spacer piece 18, a side plate 19 having an axle bearing 20, and a cover plate 21 having a shaft bearing 22.

It is also characteristic that the rotor shaft 12 provided with a chain wheel as a drive wheel 23, outside the pump housing 1, is configured in multiple parts and consists, on the one hand, of a hollow rotor shaft 24 mounted in the pump housing 1, the inside diameter of which, in the center region of the vane rotor 3, corresponds to the inside diameter of the cylinder guide 13.

It is characteristic, in this connection, that the cylinder guide 13 is configured, in this construction as well, in that a bearing ring 25 is disposed, in the free end of the hollow rotor shaft 24 having the inside diameter of the cylinder guide 13, in torque-proof manner.

It is essential to the invention, also in this embodiment of the solution according to the invention, that the hollow rotor shaft 24 connected with the bearing ring 25 in torque-proof manner is mounted so as to rotate on a bearing axle 26 disposed in the pump housing 1 in torque-proof manner, by means of this bearing ring 25.

In FIG. 5, the vane cell pump according to the invention is now shown as a dual-chamber pump having a pivotable setting slide 7, in radial section.

In this connection, this solution according to the invention, of a dual-chamber pump having a pivotable setting slide 7, demonstrates all the characteristics that are essential to the invention and have already been explained in connection with FIGS. 1 and 2.

FIG. 6 now shows a vane cell pump according to the invention in the construction as a free-chamber pump having a pivotable setting slide 7, in radial section.

Also this solution according to the invention, of a free-chamber pump having a pivotable setting slide 7, shown in FIG. 6, once again demonstrates all the characteristics that are essential to the invention and have already been explained in connection with the free-chamber pump shown in FIGS. 3 and 4.

Thus, it can be stated, in summary, that all the constructions of the vane cell pump according to the invention presented in exemplary embodiments 1 to 6 eliminate the disadvantages of the state of the art explained initially, clearly lower the friction and leakage losses, guarantee optimal filling and emptying of the pump chambers, in terms of flow technology, in the lower as well as the upper speed of rotation range, at a minimal outside diameter, and clearly reduce power losses.

Because all the constructions of the vane cell pump according to the invention shown in FIGS. 1 to 6 can furthermore be produced in simple manner, in terms of production technology, and assembled in simple manner, the production costs are also clearly reduced as compared with the constructions of the state of the art.

As a result of the means/effect relationships of the assemblies according to the invention explained in connection with FIGS. 1 to 3, it was possible to minimize the friction and thus also the wear of the assemblies, and, in this connection, to clearly increase the reliability and useful lifetime of the vane cell pumps according to the invention.

Because of the precise production that becomes possible by means of the solution according to the invention, and a noticeable reduction in friction that results from this, if nothing else, the present solution is furthermore characterized by very low-noise operation both at low but also at high speeds of rotation, and, at the same time, guarantees a high specific conveying volume flow at a high volumetric degree of effectiveness, both at low and at high speeds of rotation (in the range from 4,500 rpm to more than 6,000 rpm).

REFERENCE SYMBOL LISTING

1 pump housing
2 drive shaft
3 vane rotor
4 bearing groove
5 vane plate
6 inner cylinder
7 setting slide
8 inflow channel
9 inflow kidney
10 outflow opening
11 outflow channel
12 rotor shaft
13 cylinder guide
14 vane plate guide crosspiece
15 synchronization cylinder
16 overflow kidney
17 outer ring
18 spacer piece
19 side plate
20 axle bearing
21 cover plate
22 shaft bearing
23 drive wheel
24 hollow rotor shaft
25 bearing ring
26 bearing axle
27 guide groove [in the text itself, this is sometimes called a guide groove]

The invention claimed is:

1. A vane cell pump having a pump housing and a rotor shaft, wherein the rotor shaft comprises a drive shaft mounted in the pump housing and a hollow rotor shaft connected with the drive shaft, wherein in certain regions, radial bearing grooves are disposed in the wall of the hollow rotor shaft, vane plates that project radially through the hollow rotor shaft are mounted in radially displaceable manner in the radial bearing grooves, wherein the hollow rotor shaft with the vane plates is enclosed by a cylinder mantle of an inner cylinder, wherein the inner cylinder is disposed in a setting slide that is mounted in the pump housing to be displaceable or pivotable along predetermined paths, wherein the vane cell pump has an inflow channel disposed in the pump housing, wherein at least one inflow kidney disposed in at least one side wall of the pump housing on one or both sides of the setting slide empties into the inflow channel, wherein the vane cell pump has an outflow channel also disposed in the pump housing, wherein a cylinder guide is disposed in the hollow rotor shaft, wherein a freely circulating synchronization cylinder is guided in the cylinder guide, wherein vane-shaped vane plate guide crosspieces having crosspiece bearing grooves project beyond the hollow rotor shaft radially by 0.75 to 1.8 times the diameter of the synchronization cylinder in the region of the crosspiece bearing grooves, are assigned to the radial bearing grooves of the hollow rotor shaft, and are rigidly disposed on the hollow rotor shaft, in such a manner that the hollow rotor shaft and the vane plate guide crosspieces together form a vane rotor, wherein the vane plates are also disposed in the crosspiece bearing grooves of the vane-shaped vane plate guide crosspieces, wherein the radial bearing grooves of the hollow rotor shaft lie in the plane of the crosspiece bearing grooves of the vane plate guide crosspieces, in each instance, and make a transition into the crosspiece bearing grooves, in each instance, in such a manner that the vane plates reach all the way into the cylinder guide and lie both against the synchronization cylinder on an inside of the vane plates and against the inner cylinder of the setting slide on an outside of the vane plates, wherein at least one continuous outflow opening that runs radial to the inner cylinder is disposed in the setting slide, and wherein the at least one continuous outflow opening lies opposite the at least one inflow kidney disposed in the at least one side wall of the pump housing.

2. The vane cell pump according to claim 1, wherein the vane plate guide crosspieces are connected with one another, at their outer circumference, via an outer ring provided with outer ring bearing grooves, wherein at least one overflow kidney that surrounds the outer ring is disposed on one or both sides of the setting slide in the region of the outer ring and in the at least one side wall of the pump housing, in the inflow region provided with the inflow kidney, and wherein the at least one overflow kidney allows flow of the conveying medium out of at least one inner chamber, around the outer ring, by way of the at least one overflow kidney.

3. The vane cell pump according to claim 2, wherein a circumferential guide groove is disposed on one or both sides of the setting slide, in the region of the outer edge of the at least one inner chamber, adjacent to the outer ring, in the at least one side wall of the pump housing, and wherein the circumferential guide groove makes a transition into the at least one overflow kidney.

4. The vane cell pump according to claim 1, wherein the radial bearing grooves of the rotor shaft project beyond the vane plate guide crosspieces of the vane rotor in the longitudinal rotor shaft direction.

5. The vane cell pump according to claim 1, wherein the pump housing is constructed of multiple parts comprising a spacer piece a side plate having an axle bearing, and a cover plate having a shaft bearing.

6. The vane cell pump according to claim 1, wherein the drive shaft is connected in one piece with the vane rotor.

7. The vane cell pump according to claim 1, wherein the rotor shaft mounted in the pump housing, is provided with a drive wheel outside of the pump housing and is configured in multiple parts, wherein the hollow rotor shaft has an inside diameter, in the center region of the vane rotor, that corresponds to the inside diameter of the cylinder guide, and wherein the cylinder guide is delimited, at the side, in such a manner that a bearing ring having the inside diameter of the cylinder guide is disposed in the free end of the hollow rotor shaft, in torque-proof manner, and wherein a bearing axle disposed in the pump housing is mounted in the bearing ring so as to rotate.

* * * * *

UNITED STATES PATENT AND TRADEMARK OFFICE

CERTIFICATE OF CORRECTION

PATENT NO. : 8,998,594 B2
APPLICATION NO. : 13/701594
DATED : April 7, 2015
INVENTOR(S) : Pawellek It is certified that error appears in the above-identified patent and that said Letters Patent is hereby corrected as shown below:

In the Claims

In Column 12, line 63, (Line 8 in Claim 1) before “vane plates” please insert: --wherein--.

In Column 13, line 21, (Claim 1) after the word “shaft” please delete: “,”.

In Column 14, line 26, (Line 3 of Claim 5) after the word “piece” please insert: --,--.

Signed and Sealed this
Twenty-first Day of July, 2015

Michelle K. Lee

Michelle K. Lee
*Director of the United States Patent and Trademark Office*